US005261576A

United States Patent [19]

Shirley

[11] Patent Number: 5,261,576

[45] Date of Patent: Nov. 16, 1993

[54] SEAL FOR COAL LOADING CHUTE GATE

[75] Inventor: Jon L. Shirley, Gillette, Wyo.

[73] Assignee: Atlantic Richfield Company, Los Angeles, Calif.

[21] Appl. No.: 838,123

[22] Filed: Feb. 19, 1992

[51] Int. Cl.[5] ..... B65D 47/00

[52] U.S. Cl. ..... 222/559

[58] Field of Search ..... 222/148, 181, 185, 502, 222/504, 509, 542, 559, 560, 561, 575

[56] References Cited

U.S. PATENT DOCUMENTS

| | | | |
|---|---|---|---|
| 3,556,358 | 1/1971 | Armstrong | 222/504 X |
| 4,009,906 | 3/1977 | Sweet et al. | 222/504 X |
| 4,176,767 | 12/1979 | Franche, IV | 222/561 X |
| 4,372,730 | 2/1983 | Ladt | 222/559 X |
| 4,711,373 | 12/1987 | Christine | 222/496 X |
| 4,765,517 | 8/1988 | Pavolka | 222/505 |
| 4,848,596 | 7/1989 | Rudick | 222/505 X |

*Primary Examiner*—Andres Kashnikow
*Assistant Examiner*—Kenneth DeRosa
*Attorney, Agent, or Firm*—Michael E. Martin

[57] ABSTRACT

A closure gate for a coal-loading chute has opposed flat plate closure members for controlling the flow of coal from a storage bin to transport vehicles and the like. Each closure member is provided with opposed seal assemblies engaged with opposed surfaces of the closure member to prevent leakage of coal dust. The seal assemblies comprise elongated, spaced-apart support plates for supporting an abrasion-resistant, plastic seal member characterized by an elongated flat plate which is supported between the seal assembly support plates and is spring biased into engagement with the closure member.

5 Claims, 2 Drawing Sheets

SEAL FOR COAL LOADING CHUTE GATE

BACKGROUND OF THE INVENTION

1. Field of the Invention

The present invention pertains to an improved mechanical seal assembly for use with coal and other particulate material loading chute closure gates.

2. Background

Material-handling equipment such as storage bins and associated loading chutes for coal and other particulate materials operate in a relatively harsh environment from the standpoint of life of elements such as seals. In particular, in coal-loading chutes, the coal flow control gates which allow the coal to pass from storage bins into transport vehicles and the like are constantly opened and closed such as when coal is being loaded into the hopper cars of mile-long unit trains. Accordingly, the rapid opening and closing of the gates to control the flow of coal into the railcars and the abrasive nature of the particulate material has made it difficult to provide suitable closure seals for the gates which prevent the emission of coal dust into the atmosphere around the loading facility. The present invention overcomes several problems associated with coal and other particulate material-handling equipment of the type described herein as will be appreciated from the following description.

SUMMARY OF THE INVENTION

The present invention provides an improved seal mechanism for use in coal and other particulate material-handling equipment, in particular, loading chutes for transferring coal from storage bins to transport vehicles such as railcars and the like.

In accordance with an important aspect of the present invention, a mechanical seal assembly for sealing the opposed surfaces of a plate-like charging gate closure member is provided wherein the seal provides positive mechanical contact with the gate, accommodates warpage and flexing of the gate and is easily replaced and repaired.

In accordance with another important aspect of the present invention, a seal arrangement for a coal or other particulate material loading chute is provided which is economical to manufacture, is reliable in operation and has extended life considering the harsh operating environment to which it is exposed and the repeated use which it is required to withstand.

Those skilled in the art will recognize further important aspects and advantages of the present invention upon reading the detailed description which follows.

DESCRIPTION OF A PREFERRED EMBODIMENT

Figure 1:
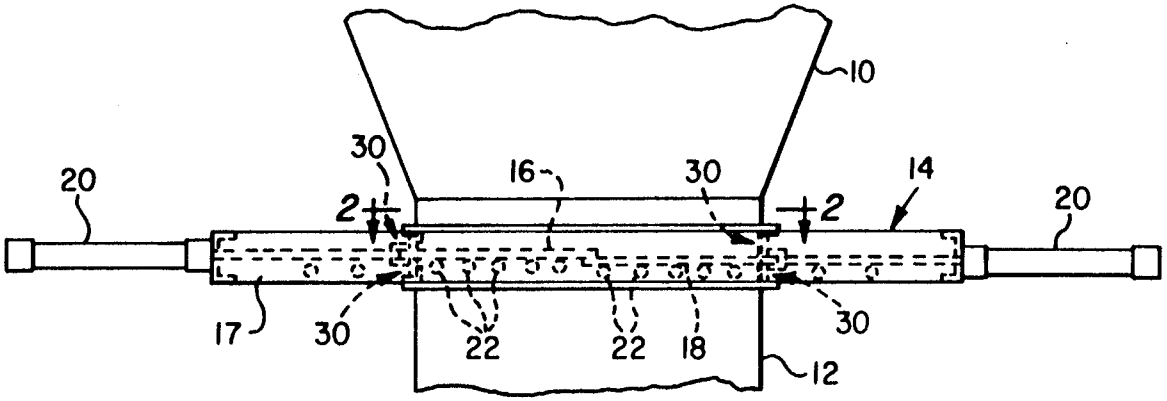
FIG. 1 is a detail side elevation of part of a coal storage bin and loading chute together with a coal flow closure gate including the seal assembly of the present invention.

In the description which follows, like parts are marked throughout the specification and drawing with the same reference numerals, respectively. The drawing figures are not necessarily to scale in the interest of clarity.

Figure 2:
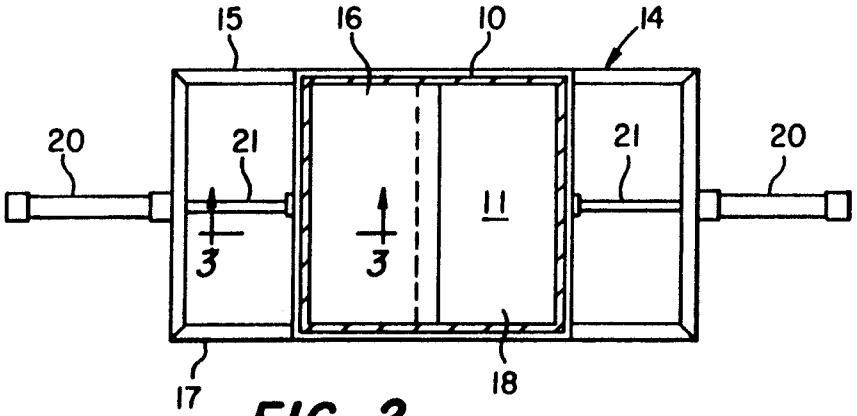
FIG. 2 is a plan view taken generally from the line 2—2 of FIG. 1.

Referring to FIGS. 1 and 2, there is illustrated a coal or similar particulate material storage bin, generally designated by the numeral 10, which is operably connected to a loading chute 12 for loading railcars or other transport vehicles, not shown. The bin 10 is connected to the loading chute 12 by a rectangular perimeter frame 14 for supporting opposed sliding closure members 16 and 18 of a closure gate for controlling the flow of coal rom the bin 10 through the chute 12 to the aforementioned transport vehicles or other destinations. The closure members 16 and 18 are operably moved between their closed positions shown in FIGS. 1 and 2 to open positions by opposed hydraulic piston and cylinder type actuators 20 which are each connected to the closure members 16 and 18 at the distal ends of their respective piston rods 21. The closure members 16 and 18 are each characterized as generally rectangular flat metal plate members which are supported for reciprocal movement on the frame 14 by suitable spaced apart rollers 22 which are supported on each of opposed parallel frame members 15 and 17 as shown in FIGS. 1, 3 and 4.

The closure members 16 and 18 are each provided with opposed mechanical seal assemblies, each generally designated by the numeral 30. The seal assemblies 30 include seal members which are operable to engage the upper and lower surfaces of the closure members 16 and 18 to prevent leakage of coal dust and other contaminants from the interior of the bin 10 and the loading chute 12 to the exterior thereof. In other words, the interior space 11, see FIG. 2, is sealed from the exterior environment of the frame 14 by the seal assemblies 30, for example. Each of the seal assemblies 30 is suitably supported on transversely-extending frame members which extend between the frame members 15 and 17. By way of example, and referring to FIGS. 3 and 4, the seal assemblies 30 for the closure member 16 are supported on opposed, transversely-extending frame members 32 and 34 which extend between the frame members 15 and 17. The frame members 32 and 34 may be conventional steel angle or "L" section members, as illustrated, and the frame members 15 and 17 may be characterized by conventional structural steel channel members.

Figure 3:
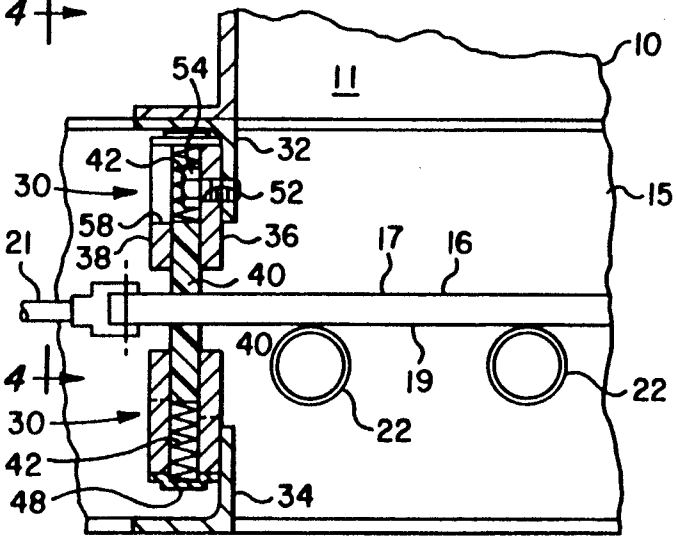
FIG. 3 is a detail section view taken generally from the line 3—3 of FIG. 2.
Figure 4:
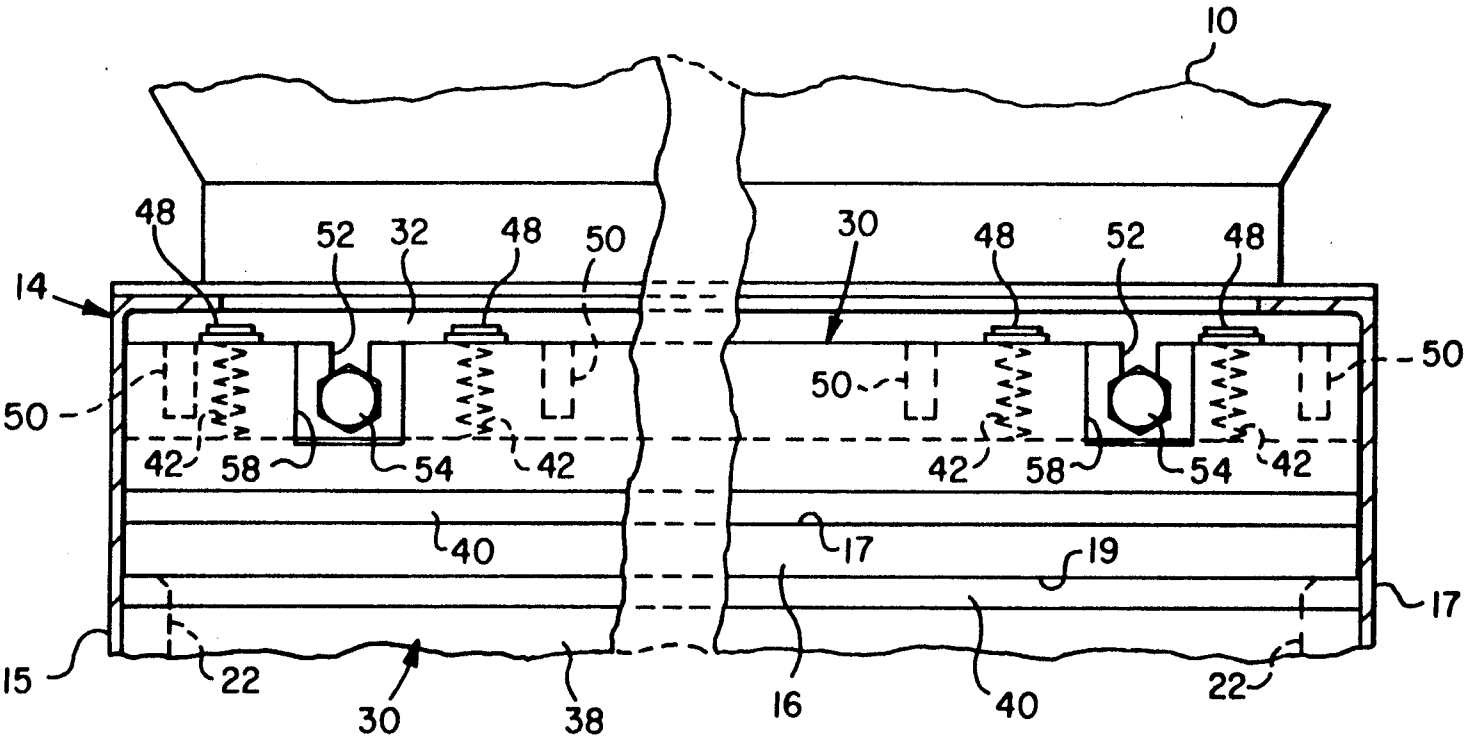
FIG. 4 is a view taken generally from the line 4—4 of FIG. 3.

As shown in FIGS. 3 and 4, the seal assemblies 30 are each characterized by spaced-apart, elongated support plate members 36 and 38 which support therebetween non-metallic, generally flat, rectangular-shaped seal members 40 which are engageable with opposite sides 17 and 19 of the closure gate member 16, FIG. 3. The seal members 40 are biased into engagement with the surfaces 17 and 19 by plural spaced-apart coil springs 42 which are interposed between the support plates 36 and 38. Each of the coil springs 42 is engageable with one side edge of a seal member 40 for biasing the seal member into engagement with a surface of one of the closure members 16 or 18. The springs 42 are also engaged with retainer caps 48 which bridge across the support plates 36 and 38 as illustrated in FIGS. 3 and 4. The retainer caps 48 are suitably secured to the support plates 36 and 38 such as by spot welding. The support plates 36 and 38 are also suitably connected to each other and held in spaced-apart relationship by a plurality of spaced apart connecting members or spacers 50, FIG. 4.

As further shown in FIGS. 3 and 4, each of the plates 36 has a plurality of spaced-apart slots 52 formed therein for receiving support fasteners 54 whereby the seal assemblies 30 may be supported on the respective frame members 32 and 34, for example. In like manner, the support plates 38 each include wrench clearance slots 58 formed therein and aligned with the slots 52 so that suitable tools may be applied to the fasteners 54 to secure the seal assemblies to the frame 14 or to remove the seal assemblies from the frame. Thanks to the provision of the elongated slots 52, the position of the seal assemblies 30 may be adjusted with respect to the closure member 16 as needed.

Accordingly, the seal assembly 30 may be adjusted so that the seal member 40 is firmly engaged with the closure member 16 under all operating conditions and, thanks to the biasing springs 42, the seal member is also constantly resiliently biased into engagement with the closure member 16. The seal assemblies 30 which are engaged with the closure member 16 are described in detail and illustrated in FIGS. 3 and 4. The corresponding seal assemblies 30 that are engaged with the closure member 18 are arranged in an identical manner and supported on respective support members extending transversely between the frame members 15 and 17.

The seal member 40 is preferably made of a long-wearing, abrasion-resistant plastic such as a polyurethane composition known as Ultra Poly, manufactured by Ultra Poly, Inc. of Tacoma, Wash. The support plates 36 and 38 may be of steel or similar fabricated metal and the coil springs 42 are also preferably of conventional design and construction. As illustrated in FIG. 4, the seal assemblies 30 extend substantially entirely across the frame 14 between the frame members 15 and 17 so that a seal is provided for both the upper and lower surfaces of the closure members 16 and 18. In this way coal dust and other particulates may be kept from flowing out of the coal bin space 11 and the interior of the loading chute 12 at the flow control gate formed by the closure members 16 and 18. Any flexing of the closure members 16 and 18, such as when they are moved between opened and closed positions will be accommodated by movement of the seal members 40 without breaking sealing contact with the opposed surfaces of the closure members.

Moreover, the seal assemblies 30 may be easily removed for servicing or replacement of the seal member 40 from the exterior of the coal bin loading chute structure without removing the closure members 16 and 18. In fact, with the closure members 16 and 18 in their closed positions with a load of coal in the bin 10, the seal assemblies 30 may be replaced individually without a significant flow of material out of the space between the cross support members 32 and 34 and the closure member even when the seal assemblies are removed.

Other than the materials specified above, conventional engineering materials used for material-handling equipment may be used in practicing the present invention. A preferred embodiment has been described in detail but those skilled in the art will recognize that certain substitutions and modifications may be made to the embodiment described without departing from the scope and spirit of the appended claims.

What is claimed is:

1. A seal assembly for a closure gate for a coal or other particulate material loading chute, said gate comprising a frame, and at least one generally flat plate closure member movable between gate open and closed positions, said closure member having opposed, generally flat surfaces formed thereon, and said seal assembly comprising:

spaced apart elongated support plate members connected to each other, an elongated, abrasion-resistant, generally flat plate seal member supported between said support plate members including a surface engageable with one of the surfaces formed on said closure member to form a seal;

spaced apart springs supported between said support plate members and engageable with said seal member for urging said seal member into engagement with said surface on said gate; and one of said support plate members being engaged with and supported on said frame by removable threaded fasteners.

2. The seal assembly set forth in claim 1 wherein:

said one support plate member has spaced-apart slots formed therein for receiving said fasteners for supporting said seal assembly on said frame.

3. The seal assembly set forth in claim 2 wherein:

the other of said support plate members includes slot means aligned with the slots in said one support plate member for providing wrench clearance for said fasteners.

4. The seal assembly set forth in claim 1 wherein:

said seal member comprises an abrasion resistant material characterized by polyurethane.

5. In a closure gate for a coal or other particulate material loading chute, said gate comprising opposed, generally flat plate closure members movable between gate open and gate closed positions, each of said closure members having opposed, generally flat surfaces formed thereon and said closure members being supported on a generally rectangular perimeter frame having opposed, generally planar frame members each having an outer surface and an inner surface delimiting a space for flow of said material, respective seal assemblies for said closure gate members for forming a seal against each of the opposed surfaces of each of the gate members, each of said seal assemblies comprising:

spaced apart elongated support plate members connected to each other, an elongated, abrasion-resistant, generally flat plate seal member supported between said support plate members including a surface engageable with one of the surfaces formed on said closure member to form a seal;

spaced apart springs supported between said support plate members and engageable with said seal member for urging said seal member into engagement with said surface on said closure member; and one of said support plate members being engaged with and supported on said outer surface of said frame member by removable threaded fasteners.

* * * * *